US006263768B1

(12) United States Patent
Huang et al.

(10) Patent No.: US 6,263,768 B1
(45) Date of Patent: Jul. 24, 2001

(54) RATCHET TOOL OPERATABLE AT A SMALL ANGLE

(76) Inventors: Jung-Sheng Huang, F. 1, No. 27, Lane 35, Chia-Ho Rd, Ta-Chia Chen; Yi-Ming Tung, No. 23, Tsu-Chiang 2nd St, Wuchi Town, both of Taichung Hsien; Shiu-Mei Cheng, F.4, No.51, Lane 284, Wu-Shing St., Taipei, all of (TW)

( * ) Notice: Subject to any disclaimer, the term of this patent is extended or adjusted under 35 U.S.C. 154(b) by 0 days.

(21) Appl. No.: 09/588,542

(22) Filed: Jun. 7, 2000

(51) Int. Cl.[7] ..... B25B 13/46
(52) U.S. Cl. ..... 81/63; 81/58.1; 81/57.29
(58) Field of Search ..... 81/63, 57.13, 57.29, 81/58.1

(56) References Cited

U.S. PATENT DOCUMENTS 4,137,801 * 2/1979 Imperio ..... 81/58.1
4,265,148 * 5/1981 Gartzke ..... 81/57.29
4,406,183 * 9/1983 Wix ..... 81/57.29
4,532,832 * 8/1985 Christensen ..... 81/57.29
4,545,267 * 10/1985 Shumway ..... 81/57.29
4,869,138 * 9/1989 Farris ..... 81/63
4,907,476 * 3/1990 Singleton ..... 81/57.29
5,058,463 * 10/1991 Wannop ..... 81/57.29
5,471,898 * 12/1995 Forman ..... 81/57.29
5,887,493 * 3/1999 Main ..... 81/57.29
6,145,412 * 11/2000 Cheng et al. ..... 81/57.29

* cited by examiner

*Primary Examiner*—Joseph J. Hail, III
*Assistant Examiner*—David B Thomas
(74) *Attorney, Agent, or Firm*—Rosenberg, Klein & Lee

(57) ABSTRACT

A ratchet tool includes a toothed inner periphery defined in the ring-shaped head and a rotatable member is engaged with the toothed inner periphery. A recess is defined in a surface of the head and a driving member is rotatably received in the recess. A notch is defined in a side defining the recess and communicates between the recess and a central hole in the head. An elongated protrusion extends from the rotatable member and a disk is securely mounted to the protrusion. The driving member is rotatably engaged with the disk so that when rotating the driving member, the rotatable member is able to be rotated at a small angle.

6 Claims, 7 Drawing Sheets

RATCHET TOOL OPERATABLE AT A SMALL ANGLE

FIELD OF THE INVENTION

The present invention relates to a ratchet tool, and more particularly, to a ratchet tool having a disk securely mounted to a rotatable member in the head of the tool and a driving member engaged with the disk to rotate the disk together with the rotatable member at a small angle as needed.

BACKGROUND OF THE INVENTION

Some conventional ratchet tools known to applicant are U.S. Pat. No. 4,137,801 with a title of "COMBINED RATCHET AND TORSION WRENCH" to Imperio, U.S. Pat. No. 4,406,183 with a title of "FAST ACTING RATCHET WRENCH" to Wix, U.S. Pat. No. 4,265,148 with a title of "RATCHET TOOL" to Gartzke, U.S. Pat. No. 4,907,476 with a title of "SOCKET WRENCH WITH IMPROVED HANDLE" to Sidewinder Products Corporation, the Assignee, U.S. Pat. No. 4,532,832 with a title of "DUAL-MODE RATCHET WRENCH" to Christensen, U.S. Pat. No. 4,545,267 with a title of "COMBINATION GEAR RATCHET WRENCH APPARATUS" to Shumway, U.S. Pat. No. 4,869,138 with a title of "NEW AND IMPROVED RATCHET TOOL WITH ROTATABLE ROTOR LOCK AND RIGID SHIFTER FINGER" to Farris, U.S. Pat. No. 5,058,463 with a title of "RATCHET WRENCH WITH DUAL-ROTATING CONSTANT DRIVE HANDLE" to Midland Design Inc., the Assignee, U.S. Pat. No. 5,471,898 with a title of "BREAKER BAR WITH 90 DEGREE ROTATING SOCKET CONNECTOR HEAD" to Forman, and U.S. Pat. No. 5,887,493 with a title of "RATCHET WRENCH" to Main. The ratchet tools commonly have a complex structure which is composed of a lot of parts. The manufacturing processes are time and money costly.

The present invention intends to provide a ratchet tool which has a disk securely mounted to the rotatable member in the head of the tool and engaged with a driving member rotatably controlled by the user so that when the handle is not able to be rotated, the driving is rotated to rotate the rotatable member.

SUMMARY OF THE INVENTION

In accordance with one aspect of the present invention, there is provided a ratchet tool and comprising a ring-shaped head having a central hole which has a toothed inner periphery, and a recess defined in a first surface of the head. A passage is defined in the handle and the passage communicates with the recess. A rotatable member is rotatably received in the head and a pawl member is pivotally connected to the rotatable member, wherein the pawl member is engaged with the toothed inner periphery of the head. An elongated protrusion extends from the rotatable member and a disk is securely mounted to the elongated protrusion. A driving member is received in the recess and an operation rod is rotatably received in the passage and connected to the driving member. The driving member is rotatably engaged with the disk so that when rotating the driving member, the rotatable member is rotated.

The object of the present invention is to provide a ratchet tool that has a driving member engaged with a disk on the rotatable member so that when the handle of the tool cannot be rotated in a narrow area, the rotatable member can be rotated by rotating the driving member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
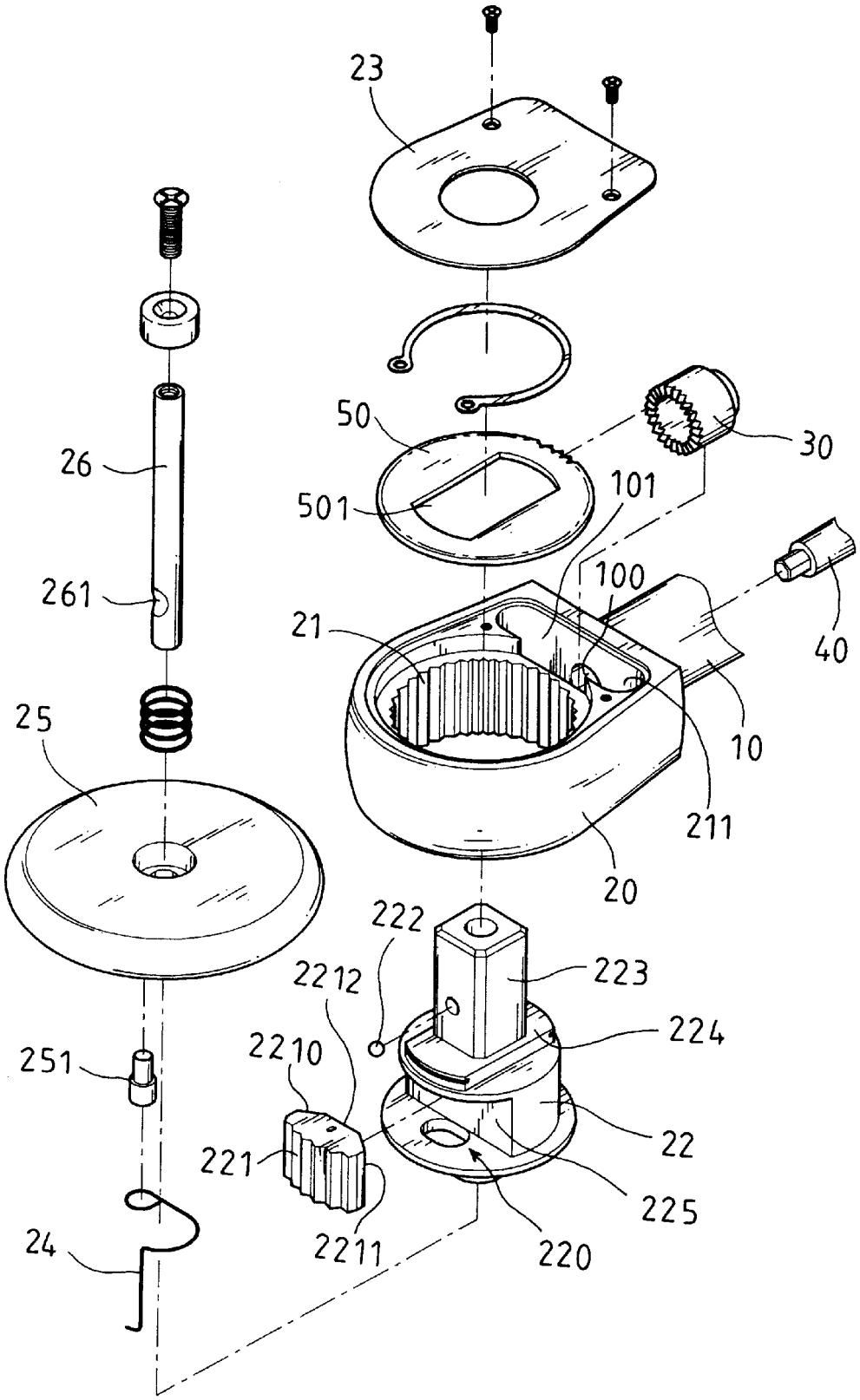
FIG. 1 is an exploded view to show a ratchet tool of the present invention.
Figure 2:
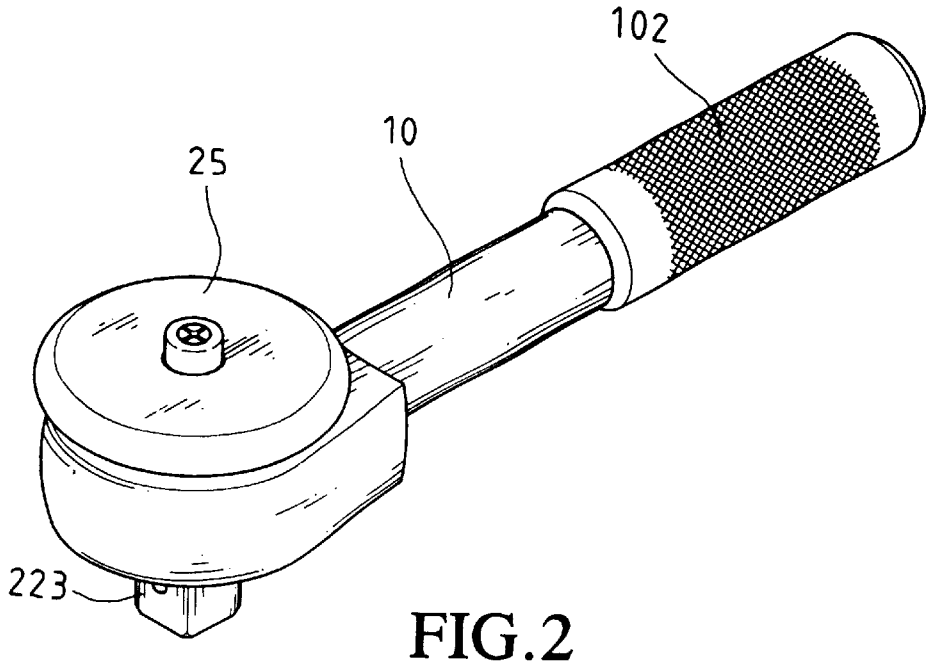
FIG. 2 is a perspective view to show the ratchet tool of the present invention.
Figure 3:
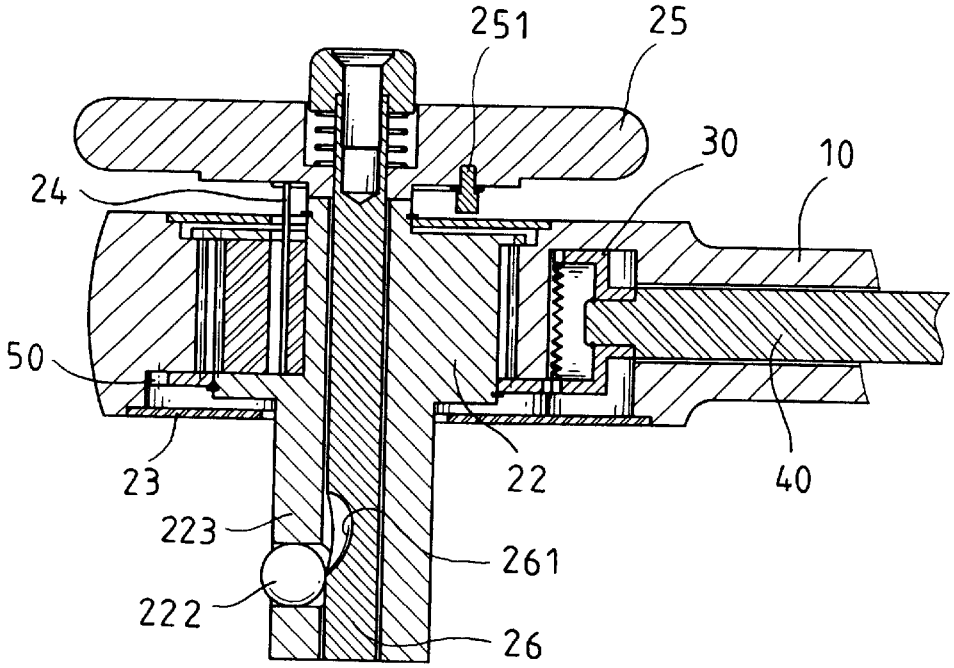
FIG. 3 is a side cross sectional view to show the present invention.

Referring to FIGS. 1 to 3, the ratchet tool in accordance with the present invention comprises a ring-shaped head 20 connected to a handle 10 and the head 20 has a central hole which has a toothed inner periphery 21. A recess 211 is defined in a first surface of the head 20 and a passage 100 is defined in the handle 10, wherein the passage 100 communicates with the recess 211. A side defining the recess 211 has a notch 101 which communicates between the recess 211 and the central hole of the head 20. A rotatable member 22 is rotatably received in the head 20 and an elongated protrusion 224 extends from the rotatable member 22. A disk 50 having an elongated hole 501 is securely mounted to the elongated protrusion 224 so that the disk 50 is co-rotated with the rotatable member 22. An engaging rod 223 extends from a surface of the elongated protrusion 224 of the rotatable member 22 and a ball 222 is engaged with a side of the engaging rod 223 so as to securely hold a socket onto the engaging rod 223. A cap 23 is mounted to the first surface of the head to retain the disk 50 in position. The rotatable member 22 has a recessed portion 220 is defined radially in the periphery of the rotatable member 22 and the recessed portion 220 is defined by two parallel surfaces and a first flat surface 225 connected between the two parallel surfaces. The pawl member 221 is pivotally received in the recessed portion 220 and is connected between the two parallel surfaces. The pawl member 221 has two oblique surfaces 2210, 2211 with a second flat surface 2212 connected between the two oblique surfaces 2210, 2211. One of the two oblique surfaces 2210, 2211 and the second flat surface 2212 is engaged with the first flat surface 225 defining the recessed portion 220. Another cap 25 having a hole is mounted to a second surface of the head 20 and has a connection rod 251 on a surface thereof so that a spring 24 is connected between the connection rod 251 and the pawl member 221. A movable rod 26 having a dent 261 extends through the hole in the cap 25 and is inserted into the engaging rod 223 so that when the ball 22 is received in the dent 261, the socket (not shown) mounted to the engaging rod 223 can be removed from the engaging rod 223.

Figure 5:
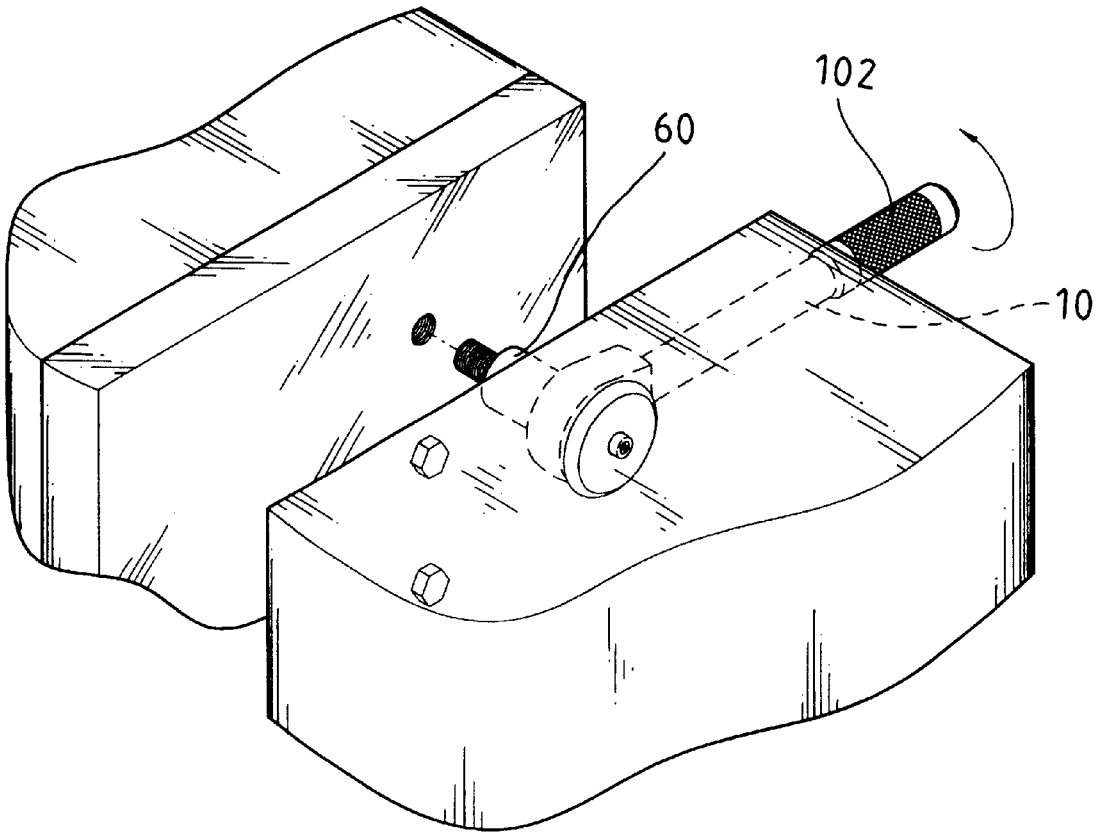
FIG. 5 is an illustrative view to show the rotatable member is rotated at a small angle by rotating an operation handle.
Figure 6:
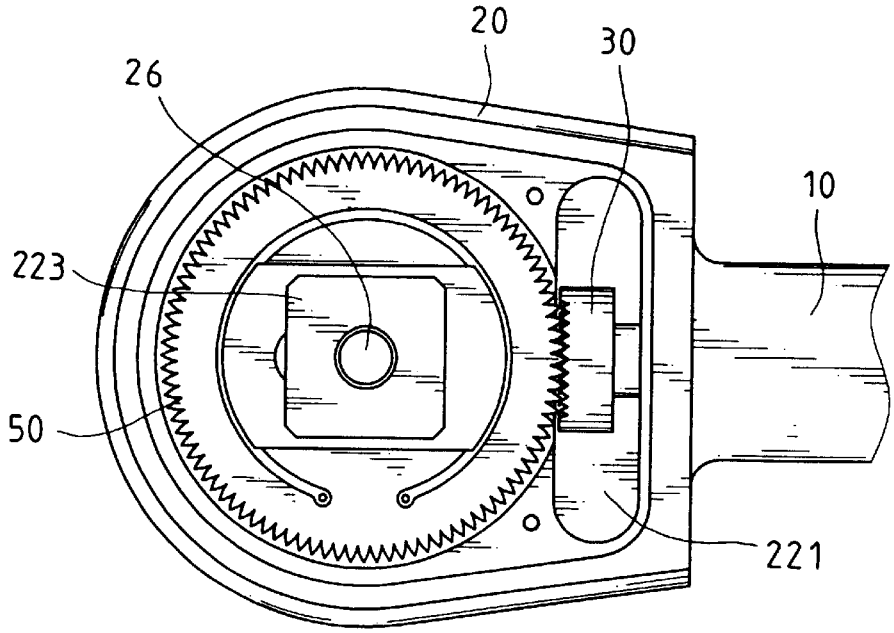
FIG. 6 is a top cross sectional view to show the driving member is engaged with the disk on the rotatable member of the tool.

Further referring to FIG. 6, a driving member 30 is received in the recess 211 and an operation rod 40 is rotatably received in the passage 100 and connected to an operation handle 102 as shown in FIG. 5. The driving member 30 is a tubular member and has an annular toothed end, the disk 50 has a toothed outer periphery which is engaged with the annular toothed end via the notch 101. As shown in FIG. 5, when the handle 10 is not able to be rotated or the rotatable member 22 is required to be rotated at a small angle, a user rotates the operation handle 102 to rotate the driving member 30 to rotate the disk 50.

Figure 4B:
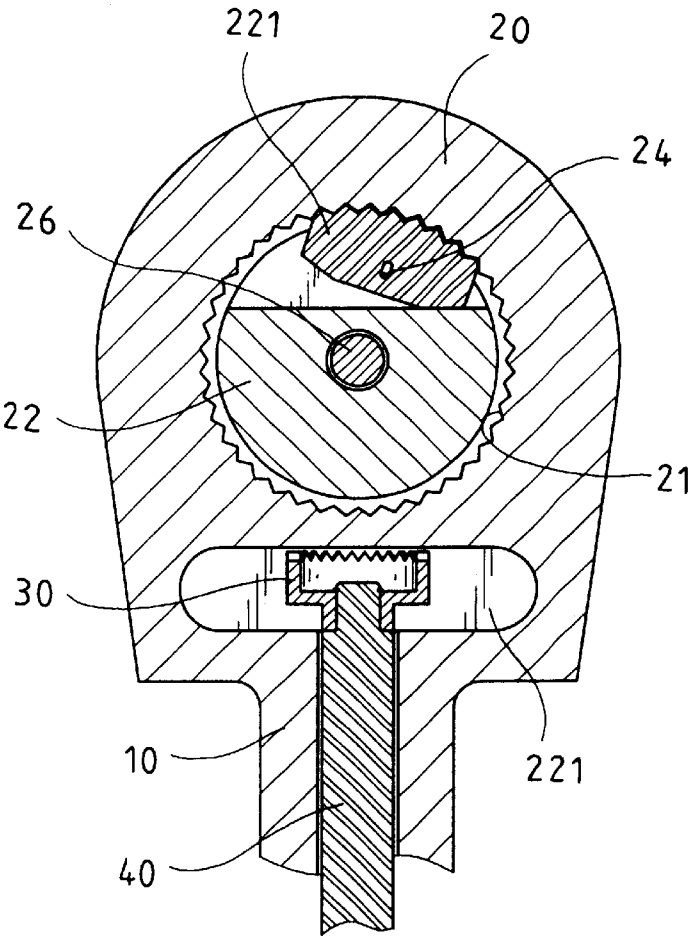
FIG. 4B is a top cross sectional view to show the other end of the pawl member is engaged with the toothed inner periphery of the head of the tool.
Figure 4A:
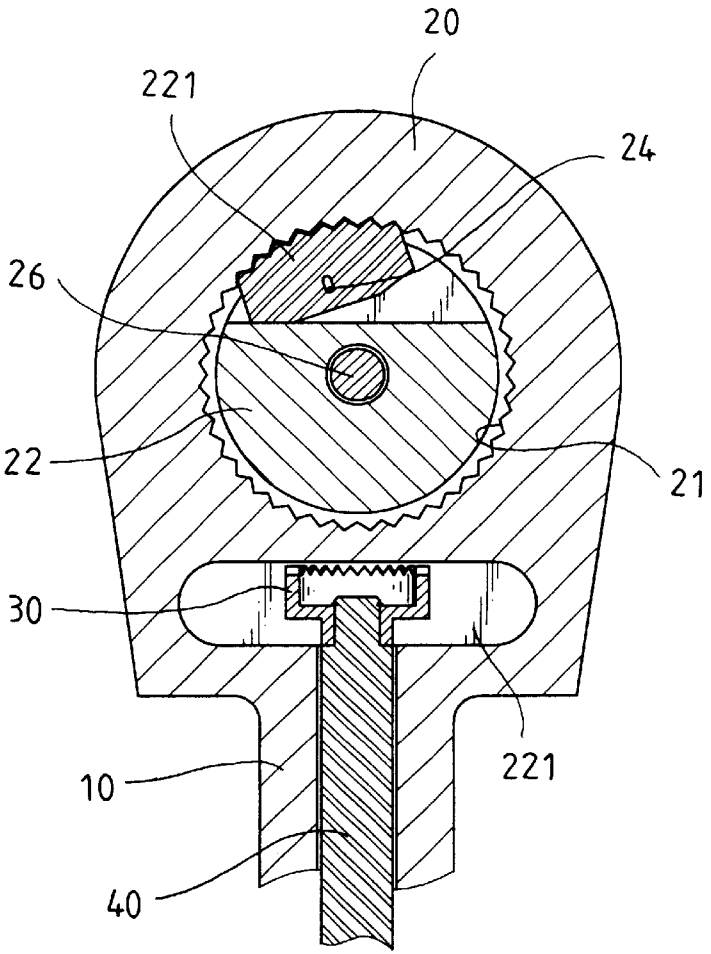
FIG. 4A is a top cross sectional view to show an end of the pawl member is engaged with the toothed inner periphery of the head of the tool.

As shown in FIGS. 4A and 4B, one of the two oblique surfaces 2210, 2211 of the pawl member 221 is chosen to contact the first flat surface 225 to let one of two ends of the teeth on the pawl member 221 to engage with the toothed inner periphery 21. The contact surface area of the first flat surface 225 and either of the two oblique surfaces 2210, 2211 decides the torque that can be output. When the first flat surface 225 contacts the second flat surface 2212, the pawl member 221 is disengaged from the toothed inner periphery 21.

Figure 7:
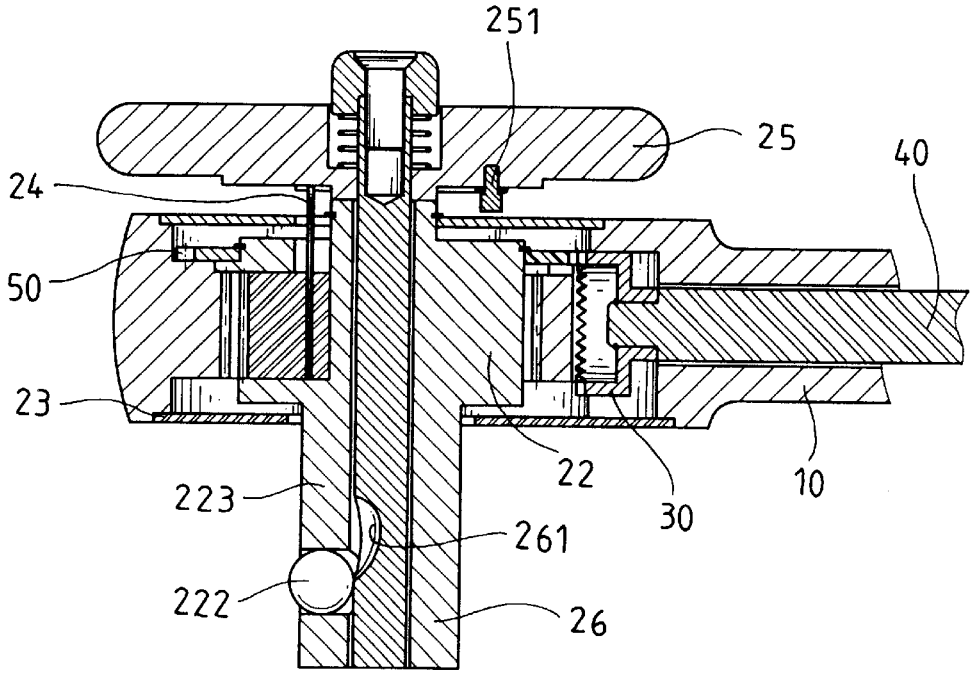
FIG. 7 is a side cross sectional view to show another embodiment of the present invention wherein the disk is connected to the other end of the rotatable member.

As shown in FIG. 7, the disk 50 may be connected to the other end of the rotatable member 22.

Figure 8:
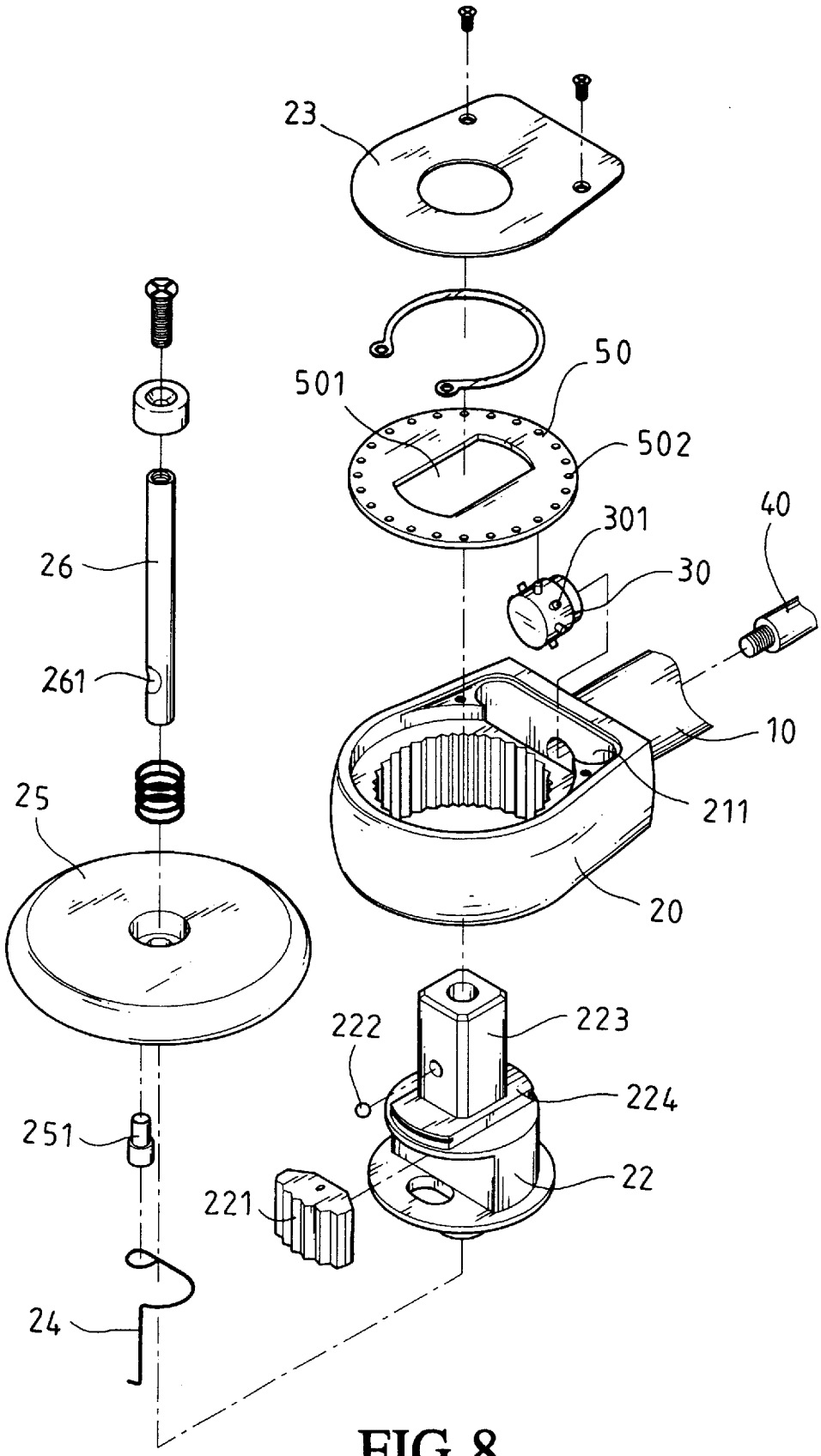
FIG. 8 is an exploded view to show another embodiment of the driving member and the disk of the ratchet tool of the present invention.
Figure 9:
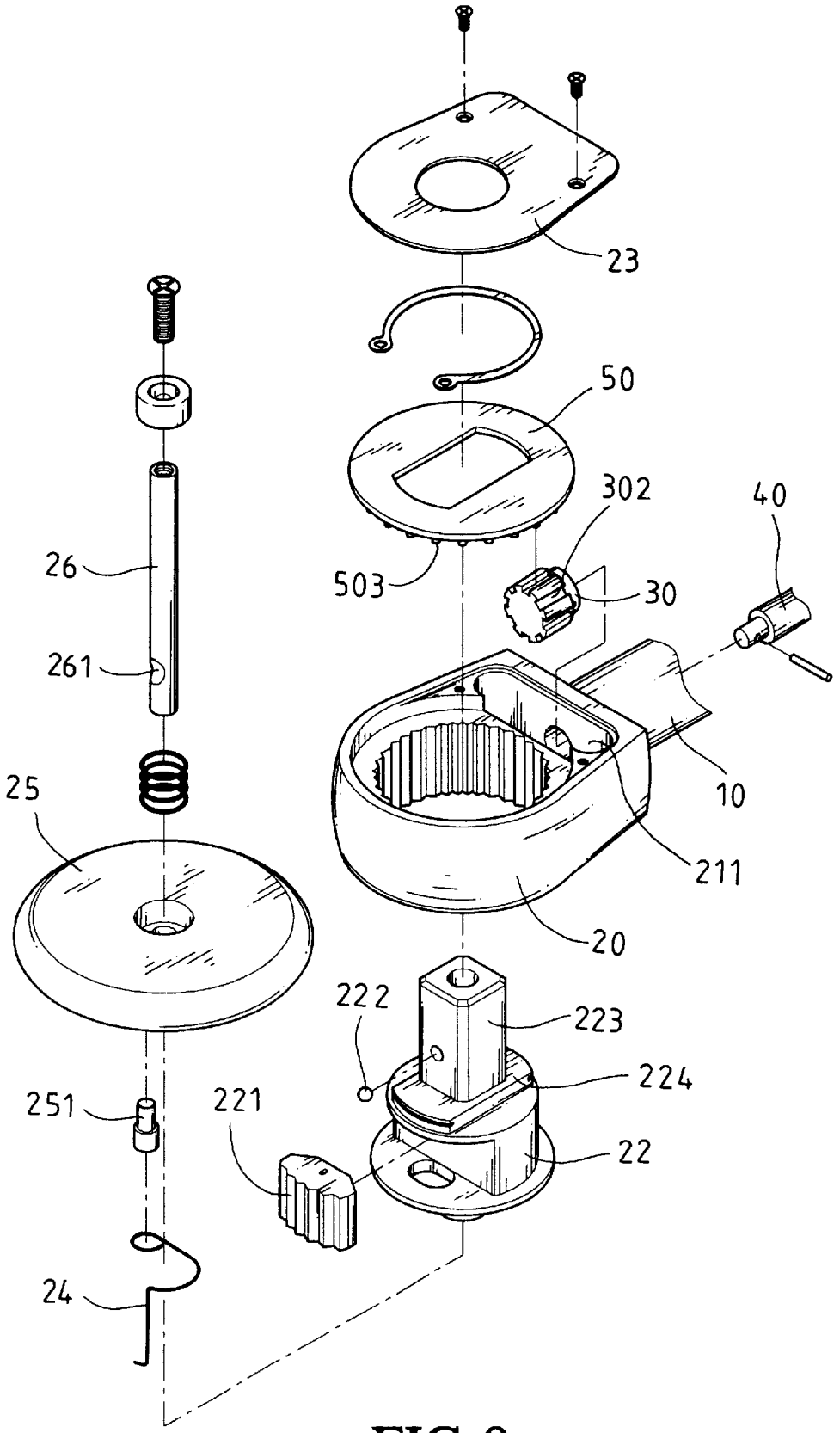
FIG. 9 is an exploded view to show yet another embodiment of the driving member and the disk of the ratchet tool of the present invention.

FIG. 8 shows another embodiment of the driving member 30 and the disk 50 of the ratchet tool of the present invention, wherein the driving member 30 is a tubular member and a plurality of extensions 301 extend radially outward from the driving member 30. The disk 50 has a plurality of apertures 502 defined therethrough for receiving one of the extensions 301. Accordingly, when rotating the driving member 30, the disk 50 is rotated by the rotational movement of the extensions 301 which are engaged with the apertures 502. FIG. 9 shows yet another embodiment of the driving member 30 and the disk 50 of the ratchet tool of the present invention, wherein the driving member 30 is a tubular member and a plurality of grooves 302 are defined radially in the driving member 30. The disk 50 has a plurality of ridges 503 extending from a surface thereof so that the ridges 503 engaged with the grooves 302.

While we have shown and described various embodiments in accordance with the present invention, it should be clear to those skilled in the art that further embodiments may be made without departing from the scope and spirit of the present invention.

What is claimed is:

1. A ratchet tool comprising:

a ring-shaped head connected to a handle and having a central hole which has a toothed inner periphery, a recess defined in a first surface of said head and a passage defined in said handle, said passage communicating with said recess;

a rotatable member rotatably received in said head and a pawl member pivotally connected to said rotatable member, said pawl member engaged with said toothed inner periphery of said head, an elongated protrusion extending from said rotatable member, an engaging rod extending from a surface of said elongated protrusion of said rotatable member, a disk securely mounted to said elongated protrusion and a cap rotatably mounted to a second surface of said head, a spring connected between said pawl member and said cap, and a driving member received in said recess and an operation rod rotatably received in said passage and connected to said driving member, said driving member rotatably engaged with said disk so that when rotating said driving member, said rotatable member is rotated.

2. The ratchet tool as claimed in claim 1, wherein a side defining said recess has a notch which communicates between said recess and said central hole of said head, said driving member engaged with said disk via said notch.

3. The ratchet tool as claimed in claim 1, wherein said driving member is a tubular member and has an annular toothed end, said disk has a toothed outer periphery which is engaged with said annular toothed end.

4. The ratchet tool as claimed in claim 1, wherein said driving member is a tubular member and a plurality of extensions extend radially outward from said driving member, said disk having a plurality of apertures defined therethrough for receiving one of said extensions.

5. The ratchet tool as claimed in claim 1, wherein said driving member is a tubular member and a plurality of grooves are defined radially in said driving member, said disk having a plurality of ridges extending from a surface thereof so that said ridges engaged with said grooves.

6. The ratchet tool as claimed in claim 1, wherein said rotatable member has a recessed portion defined radially therein and said recessed portion defined by two parallel surfaces and a first flat surface connected between said two parallel surfaces, said pawl member pivotally connected between said two parallel surfaces, said pawl member having two oblique surfaces with a second flat surface connected between said two oblique surfaces, one of said two oblique surfaces and said second flat surface engaged with said first flat surface defining said recessed portion.

* * * * *